United States Patent [19]

LeFebvre

[11] 4,048,726

[45] Sept. 20, 1977

[54] APPARATUS FOR SIGHTING A PROJECTILE FIRING WEAPON

[76] Inventor: Albert W. LeFebvre, 11½ Wilmington Road, Lake Placid, N.Y. 12946

[21] Appl. No.: 639,530

[22] Filed: Dec. 10, 1975

[51] Int. Cl.[2] ..... G08B 21/00

[52] U.S. Cl. ..... 33/180 R; 35/29 R; 116/124 R; 340/282

[58] Field of Search ..... 33/180 R, 265; 35/25, 35/29 R; 116/124 R; 124/23 R, 24 R; 340/220, 282; 273/1 E, 95 R, 101

[56] References Cited

U.S. PATENT DOCUMENTS

| | | | |
|---|---|---|---|
| 1,273,034 | 7/1918 | Coleman | 340/282 |
| 2,064,603 | 12/1936 | Harrison | 35/29 R |
| 2,791,762 | 5/1957 | Berry | 340/282 |
| 3,291,111 | 12/1966 | Smith | 33/180 R |
| 3,306,616 | 2/1967 | Baldwin et al. | 273/101 |

*Primary Examiner*—Richard E. Aegerter
*Assistant Examiner*—Richard R. Stearns
*Attorney, Agent, or Firm*—Pollock, Vande Sande & Priddy

[57] ABSTRACT

An apparatus for sighting a projectile firing weapon includes signal generators for producing signals when the weapon is oriented for firing at a pre-selected elevation and azimuth. An actuator mounted on the weapon activates the signal generators when the weapon is in the desired position. The device is particularly suited for use by blind persons and provides an audible signal which may be used to indicate when a weapon such as a bow and arrow, rifle or pistol has been properly oriented by the user for firing at a distant target.

10 Claims, 8 Drawing Figures

FIG. 1
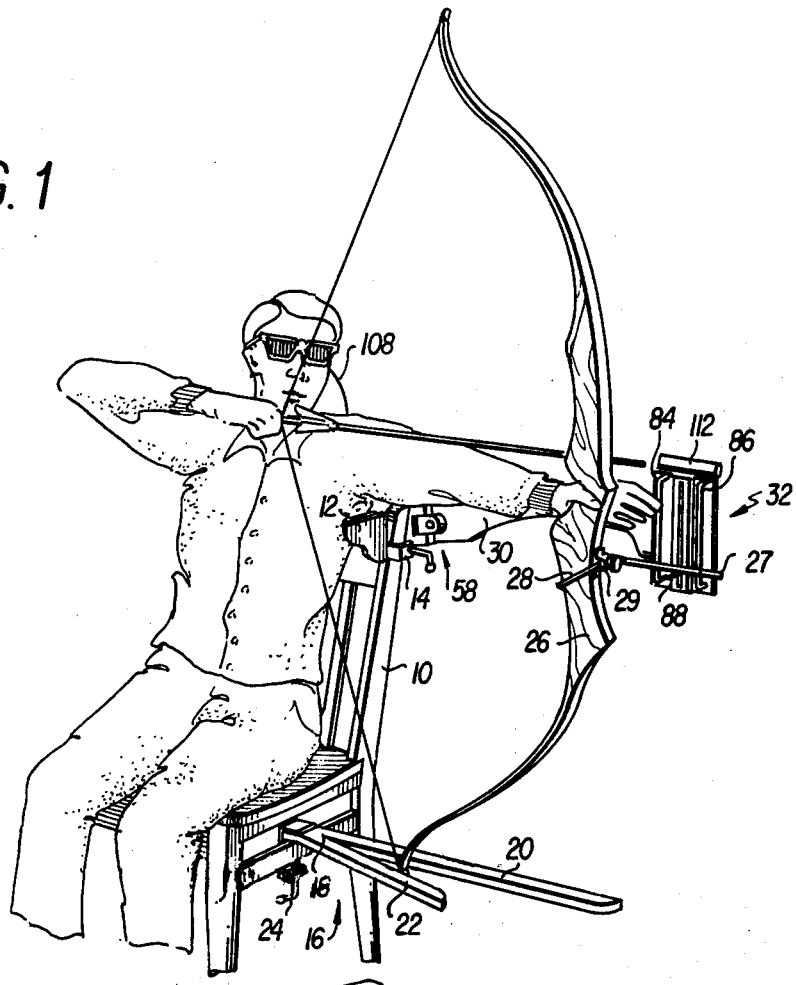
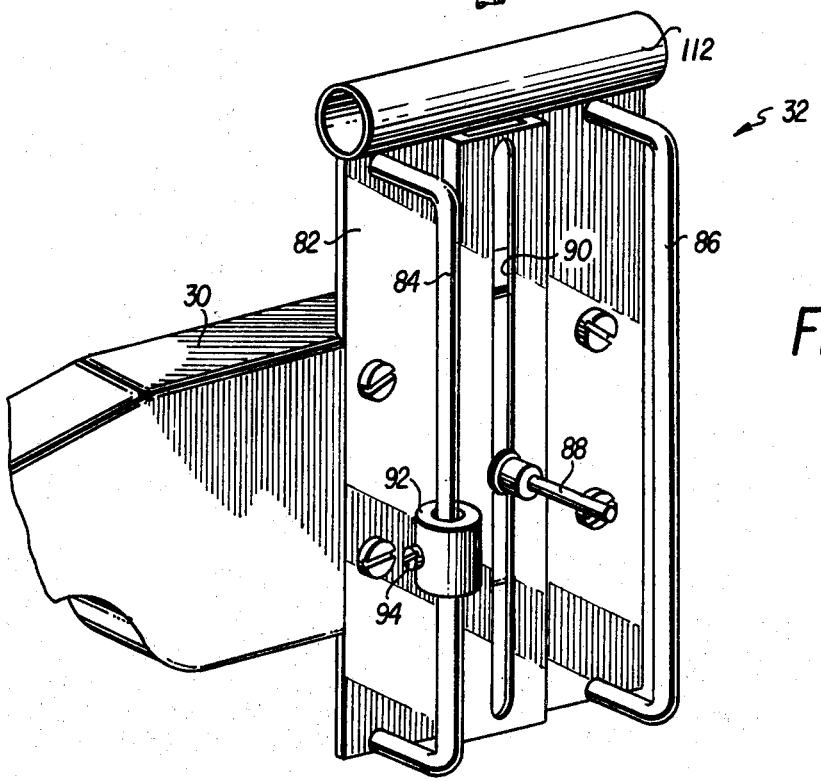
FIG. 7

FIG. 2
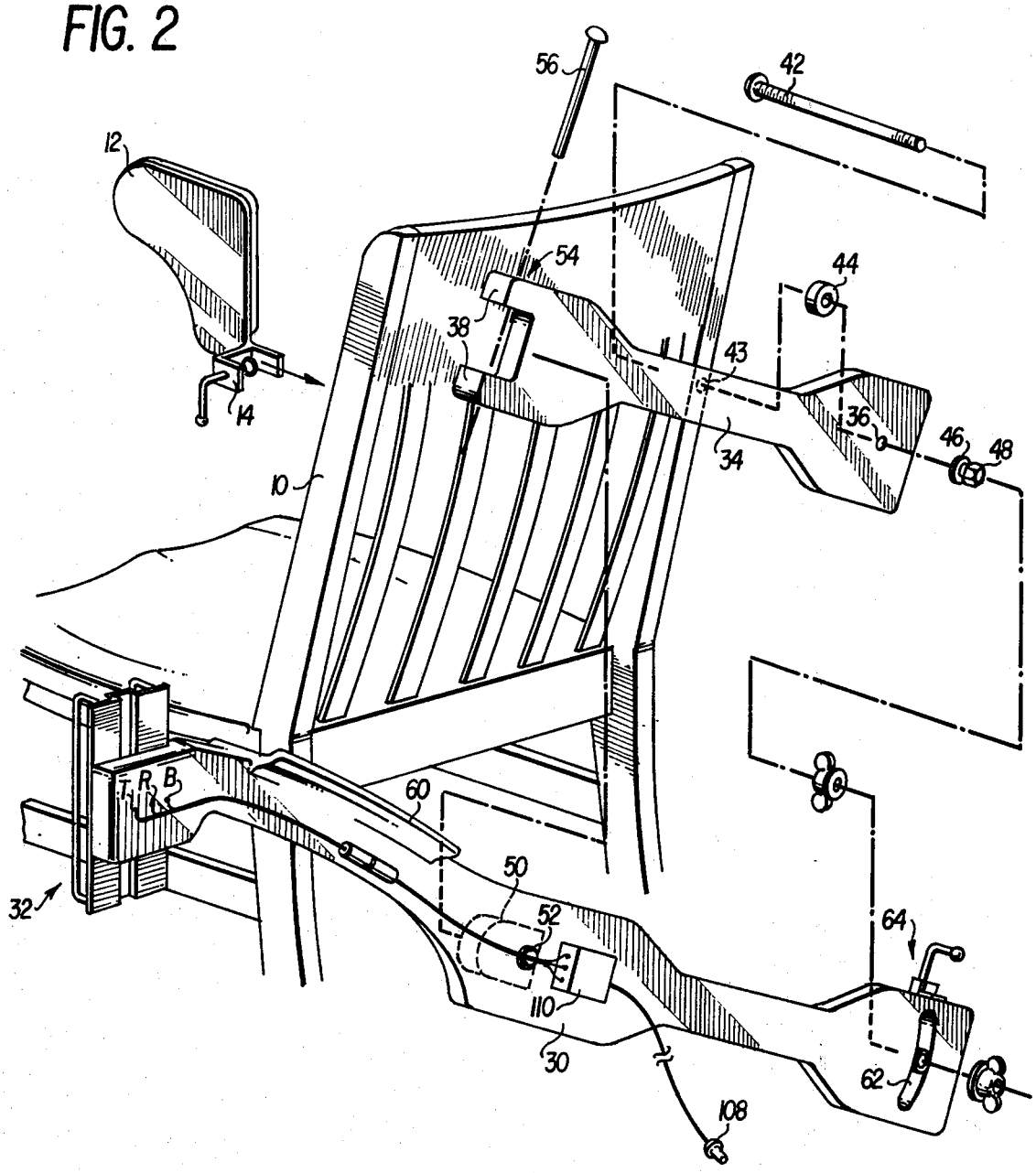
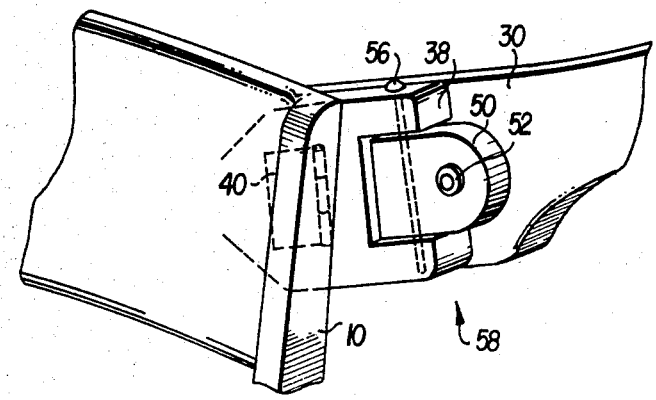
FIG. 3

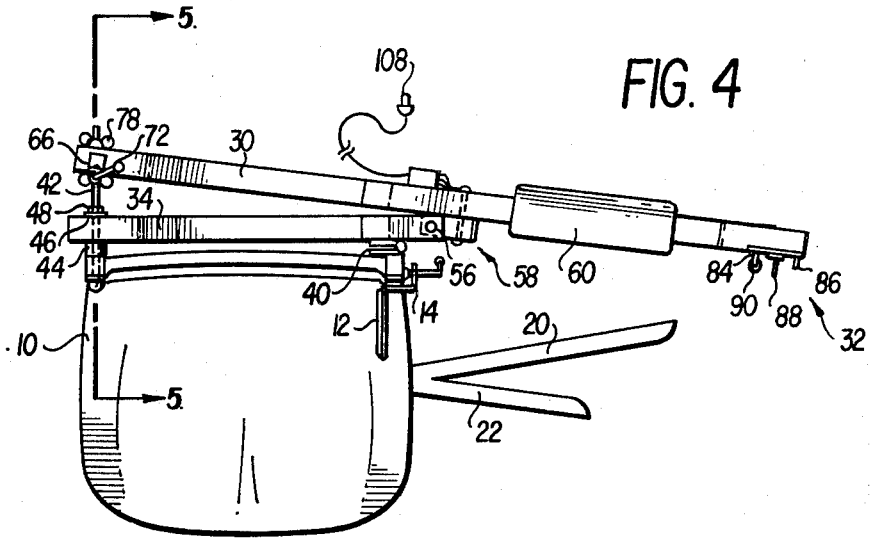
FIG. 4
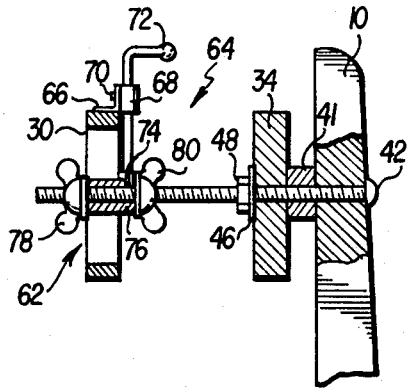
FIG. 5
FIG. 6
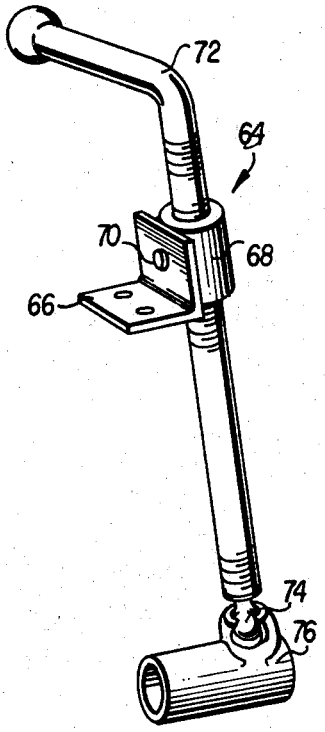
FIG. 8
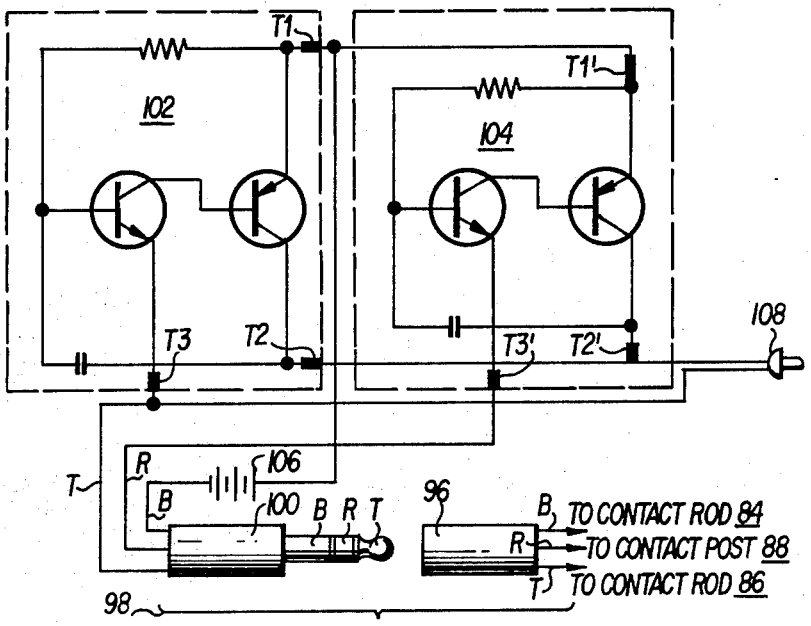

APPARATUS FOR SIGHTING A PROJECTILE FIRING WEAPON

BACKGROUND OF THE INVENTION

Many sightless individuals are frequently frustrated by the lack of special equipment and instruction necessary to enable them to participate in various leisure and sport activities enjoyed by sighted persons. In the past, it has been known to provide special adjuncts to assist blind persons in enjoying acitivities such as bowling; however, other sports such as archery, riflery and pistolry have been closed to blind persons due to the unavailability of an adequate sighting apparatus for their use.

OBJECTS OF THE INVENTION

An object of the invention is to provide a sighting apparatus for use with projectile firing weapons such as bow and arrow, rifle and pistol, to permit blind persons to fire the weapons with a minimum of assistance from sighted persons.

A further object of the invention is to provide a sighting apparatus which can be easily adjusted by the user to change the elevation and azimuth of the weapon at the time of firing.

A further object of the invention is to provide a sighting apparatus which includes an audible signalling means to indicate to the user when the weapon has been oriented properly for firing at a target.

Yet another object of the invention is to provide a sighting apparatus which is relatively simple in construction and inexpensive to manufacture so that it will be readily obtainable by blind individuals and training centers for the blind.

Still another object of the invention is to provide a sighting system which is readily adaptable for use with bow and arrow, rifle or pistol.

The above objects of the invention are given by way of example only. Thus, those skilled in the art may perceive other desirable objects and advantages inherently achieved by the invention. Nonetheless, the scope of the invention is to be limited only by the appended claims.

SUMMARY OF THE INVENTION

The above objects and other advantages are achieved by the sighting apparatus according to the invention which includes in one embodiment a first means for generating a signal when the weapon has been oriented for firing at a pre-selected elevation and a second means for generating a further signal when the weapon has been oriented for firing at a pre-selected azimuth. Means are mounted on the weapon for actuating the signal generating means when the weapon has been properly positioned. Thus, the user of the weapon is alerted by the signals that the weapon is in position for firing its projectile at a target.

In one embodiment of the invention, a fixed support is provided from which extends an elongated arm which is pivotably mounted for rotation through a plurality of elevational and azimuthal positions. At one end of the elongated arm, first and second spaced, elongated electrical contact elements are mounted. Spaced from the first and second contact elements is a third contact element. A first electrical signal generator has its power input terminal connected across the first and second contact elements and a second electrical signal generator has its power inputs connected across one of the first and second contact elements and the third contact element. An electrically conductive rod or similar element is mounted on the weapon in position to close an electrical circuit between the first and second contact elements when the weapon has been oriented at a preselected azimuth and to close an electrical circuit between one of the first or second contact elements and a third contact element when the weapon is oriented at a preselected elevation.

BRIEF DESCRIPTION OF THE DRAWINGS

FIG. 1 shows a perspective view of the invention indicating the general orientation of its components during use by an archer.

FIG. 2 shows an exploded, perspective view of various components of the invention, taken from the rear of the view shown in FIG. 1.

FIG. 3 shows a perspective view of the universal hinge joint which permits elevation and azimuth adjustments of the sighting apparatus according to the invention.

FIG. 4 shows an overhead view of a sighting apparatus according to the invention.

FIG. 5 shows a view taken along line 5—5 of FIG. 4 indicating the means for setting and locking the elevation and azimuth position of the sighting apparatus.

FIG. 6 shows the details of the elevation setting mechanism of the invention.

FIG. 7 shows a perspective view of the electrical contact board according to the invention.

FIG. 8 shows a schematic view of the signal generating circuitry used in the invention.

DETAILED DESCRIPTION OF THE PREFERRED EMBODIMENT

There follows a detailed description of a preferred embodiment of the invention, reference being made to the drawings in which like reference numerals identify like elements of structure in each of the several figures.

With reference to FIGS. 1–4, the sighting apparatus according to the invention is adapted for use with a chair 10 or other stationary support element. Although the invention is shown for use by a seated person, support elements permitting standing, kneeling and prone positions are within the scope of the invention. Attached to the upper portion of the back of chair 10 is a body positioning stop 12 which is located to contact the individual's side at approximately the area of the underarm to enable the user to repeatedly position himself in essentially the same position relative to chair 10 or another stationary support element. A clamp 14 secures body positioning stop 12 to the back of chair 10 and permits stop 12 to be moved as necessary to accomodate users of different height. In FIG. 1, the invention is illustrated for use with bow and arrow; however, those skilled in the art will realize that the principles of the invention may also be applied for use with rifle and pistol.

Extending from beneath the chair seat is a bow positioning means 16 which enables the user to locate the lower end of the bow at essentially the same location relative to chair 10 each time the sighting apparatus is used. Positioning means 16 comprises a crotched-shaped element 18 having a long arm 20 extending outwardly and toward the back of chair 10 and a short arm 22 extending outwardly and toward the front of chair 10. A clamp 24 permits positioning means 16 to be moved forward and backward on chair 10 as necessary to accomodate the individual user.

The individual illustrated in FIG. 1 is using a standard archery bow which has been modified to include an electrically conductive rod 27 which extends forward from the bow toward a target (not shown) along a path essentially parallel to the path an arrow would follow when shot from the bow. Rod 27 is preferably located approximately 3 to 3½ inches below the hand grip of the bow so as not to interfere with the archer's grip. Rod 27 includes a laterally projecting arm 28 which extends at approximately a right angle to rod 27. A screw clamp 29 or similar device secures arm 28 to the bow; whereby, the angle of rod 27 relative to the bow may be easily adjusted.

An elongated support arm 30 is pivotally attached to the back of chair 10 and arranged to allow both elevation and azimuth adjustment. Arm 3o extends generally toward the target at approximately the shoulder height of the individual. Mounted on the outer end of arm 30 is an electrical contact board 32 which includes electrical contact elements to be bridged by conductive rod 27 when the bow has been properly oriented relative to the target. The structure and function of contact board 32 will be discussed in greater detail in respect to FIGS. 7 and 8.

Referring now primarily to FIGS. 2 and 3, the assembly and cooperation of some of the major elements of the invention may be understood. A hinge support arm 34 is provided which includes at one end a bore 36 and at the opposite end a hinge yoke 38. A conventional flat hinge 40 (shown in phantom in FIG. 3 and also shown in FIG. 4) fixes hinge support arm 34 to the back of chair 10 at approximately shoulder height. At the opposite end of hinge support arm 34, a long, threaded bolt 42 is provided which extends through a bore 43 in the chair frame and through bore 36 in hinge support arm 34. Between the chair frame and support arm 34 is located a spacer 44, the thickness of which may be adjusted as desired to vary the angle of hinge support arm 34 relative to the back of chair 10. On the opposite side of support arm 34 from spacer 44, a washer 46 and nut 48 are used to secure support arm 34 to chair 10. Support arm 34 is of sufficient length so that hinge yoke 38 will extend well beyond the edge of the chair frame to permit substantial azimuthal adjustment.

A universal pivot block 50 is pivotally mounted on elongated arm 30 by means such as bolt 52, to provide for elevational adjustment. A bore 54 is provided through hinge yoke 38 and pivot block 50 at right angles to the bore for bolt 52. A bolt 56 is received within bore 54 to secure block 50 within yoke 38. Yoke 38, block 50 and bolts 52 and 56 thus permit both azimuthal and elevational adjustment, and form a universal joint 58. At one end of elongated arm 30, a curved slot 62 is provided which receives bolt 42 and permits movement of arm 30 in both elevation and azimuth.

To secure arm 30 at a given elevational setting, a jack bolt assembly 64 is provided, as shown most clearly in FIGS. 5 and 6. An angle flange 66 is rigidly attached to the upper surface of elongated arm 30. A threaded nut 68 is pivotally attached to the upwardly extending portion of angle flange 66 by a pivot hinge 70 or the like. A jack bolt 72 is threadingly received in nut 68. At the lower end of jack bolt 72, a swivel foot 74 is provided which is attached to a collar 76. Collar 76 fits within curved slot 62 and loosely surrounds bolt 42, as seen in FIG. 5. Therefore, to adjust the elevation of arm 30, jack bolt 72 is turned in the appropriate direction to raise or lower elongated arm 30.

To adjust the azimuthal position of elongated arm 30, a pair of wing nuts 78 and 80 are provided on bolt 42 on either side of collar 76. Thus, the user need only loosen wing nuts 78 and 80; move the arm to the desired position; and retighten the wing nuts. When an azimuthal adjustment is made, the elevation adjustment remains constant due to the holding effect of jack bolt assembly 64. Similarly, elevational adjustment may be made without disturbing the azimuthal setting.

From the location of universal joint 58, elongated arm 30 arches upward toward electrical contact board 32. An armrest 60 is included for steadying the user's arm while firing the weapon. As shown in FIG. 7, electrical contact board 32 comprises a support board 82 of suitable insulating material on which are located a pair of spaced, elongated electrical contact rods 84 and 86 which are oriented approximately transversely to elongated arm 30. Located between contact rods 84 and 86 is electrical contact post 88 which extend outwardly beyond rods 84 and 86. In the preferred embodiment, contact post 88 extends outwardly beyond and between contact rods 84 and 86 so that when electrically conductive rod 27 is in contact with rods 84 and 86, contact can also be made with post 88. Post 88 is adjustably mounted within a slot 90 so that the elevation contact may be moved as desired to suit a particular user. Slideably mounted on contact rod 84 is an adjustable support spool 92 which is secured in position by a set screw 94. The top surface of support spool 92 is shaped to be free of obstructions so that it will not interfere with movement of electrically conductive rod 27 into contact with contact rod 84. Spool 92 provides a fixed reference point for the archer so that when both spool 92 and contact post 88 are contacted by electrically conductive rod 28, the selected elevation may be obtained with great accuracy.

FIG. 8 shows a schematic of the signal generating circuitry activated when electrically conductive rod 27 bridges contact rods 84 and 86 and contact post 88. As shown in FIG. 2, a conductor B is connected to contact rod 84; conductor R, to contact post 88; and conductor T, to contact rod 86. Conductors B, R and T are connected respectively to the base, ring and tip terminals of the female portion 96 of a conventional stereo phono plug 98, also shown in FIG. 2. The male portion 100 of phono plug 98 is connected to a first signal generator 102, a second signal generator 104, a power source 106 such as a battery and a low impedance set of ear phones 108. Signal generators 102 and 104 and power source 106 are all located in a housing 110 located on the back side of elongated arm 30, as shown in FIG. 2.

Signal generators 102 and 104 are identical, as indicated in FIG. 8 and each may comprise a standard Morse Code practice module such as that listed under Radio Shack catalogue number 20-1155. Each generator or oscillator has three hook-up terminals: $T_1$, $T_2$ and $T_3$ in generator 102 and $T_1'$, $T_2'$ and $T_3'$ in generator 104. In both generators 102 and 104, input power is taken across terminals $T_1$ and $T_3$ and output is taken across $T_2$ and $T_3$. Terminals $T_1$ and $T_1'$ are each connected to conductor B leading from male portion 100. $T_2$ and $T_2'$ are connected to earphones 108. $T_3$ is connected to conductor T and to earphones 108; whereas, $T_3'$ is connected to conductor R.

With signal generators 102 and 104 connected to contact rods 84 and 86 and contact post 88 in this manner, the device operates as follows: When electrically conductive rod 27 bridges contact rods 84 and 86, current flows to generator 102 which produces an output signal indicating that the proper azimuthal position has been achieved when rod 28 contacts rods 84 and 86. When rod 28 contacts post 88, current also flows to generator 104 which produces a second signal to indicate that the proper elevational position has been achieved.

In use, elongated arm 30 and hinge support arm 34 are attached to chair 10 or another suitable support element so that universal hinge 58 is located at approximately the shoulder height of the user. Body positioning stop 12 and bow positioning means 16 are then located as necessary to accomodate the individual's height, arm position, bow size and related factors. At this point, arm 30 is aimed roughly at the target by a sighted person using means such as a sight tube 112 located on the upper edge of electrical contact board 32. Contact post 88 and support spool 92 are positioned so that when conductive rod 27 touches both of them, an arrow will be released at the proper elevational angle. The archer then positions himself with positioning stop 12 located at approximately the underarm area. The bow is then moved toward elongated arm 30 until the lower end of the bow contacts long arm 20 of bow positioning means 16. The bow is then drawn toward the user until its lower end seats within crotch-shaped element 18. At this time, an arrow may be fitted to the bow and a bow drawn as indicated in FIG. 1. The archer then moves the bow until electrically conductive rod 27 contacts one of rods 84 and 86 or post 88. When contact is made with both rods 84 and 86, generator 102 will produce a first output signal which produces an audible tone in earphones 108, indicating that the bow has been placed at the desired azimuthal position. The archer then lowers the bow until rod 27 contacts support spool 90 or contact post 88. The bow is then pivoted until rod 28 contacts both post 88 and spool 90. At this time, generator 104 will produce a second output signal which produces a different audible tone in earphones 108. When both tones are present in earphone 108, the archer knows that the bow has been oriented at the proper elevation and azimuth for firing. The arrow is then released.

After the arrow strikes the target, the archer is informed by a sighted person of the location of the arrow relative to the center of the target. The archer then adjusts the elevation and azimuth settings of elongated arm 30 as necessary to correct for any error in the shot. In actual use, it has been found that considerable skill is required to learn the proper type of elevation and azimuth adjustments necessary to correct for an improperly aimed shot; however, once the proper settings have been determined, it is possible to place a series of shots within a very small target area.

Having described my invention in sufficient detail to enable one of ordinary skill in the art to make and use it, I claim:

1. Apparatus for sighting a manually supported projectile firing weapon at a target comprising:

a support element fixed with respect to said target;

first means mounted on said support element for producing a first signal sensible to a person using said weapon when said weapon is oriented for firing at a pre-selected elevation;

second means mounted on said support element for producing a second signal sensible to a person using said weapon when said weapon is oriented for firing at a pre-selected azimuth;

third means mounted on said weapon for acutating said first means and said second means when said weapon is oriented at said pre-selected elevation and azimuth for firing at said target, whereby the user of said weapon is alerted by said signals that said weapon is in position for firing its projectile at said target.

2. Apparatus according to claim 1, wherein said first means comprises:

an elongated arm pivotably connected to said support element for rotation through a plurality of elevational positions;

a first signal generator having actuator elements located on said arm in position to be acutated by said third means when said weapon is oriented at said pre-selected elevation.

3. Apparatus according to claim 1, wherein said second means comprises:

an elongated arm pivotably connected to said support element for rotation through a plurality of azimuthal positions;

a signal generator having actuator elements located on said arm in position to be acutated by said third means when said weapon is oriented at said preselected azimuth.

4. Apparatus according to claim 1, wherin said third means comprises an electrically conductive rod mounted on said weapon; and said first and second means comprise electrical signal generators having input terminals positioned to be bridged by said rod to enable said generators to produce said signals.

5. Apparatus according to claim 1, wherein said first and second means comprise an elongated arm pivotably mounted to said support element for selective rotation through a plurality of elevational and azimuthal positions; first and second spaced, elongated electrical contact elements mounted on said arm and oriented essentially transversely thereto; a third electrical contact element mounted on said arm; a first electrical signal generator having its power input connected across said first and second contact elements; a second electrical signal generator having its power input connected across one of said first or second contact elements and said third contact element; and said third means comprises an electrically conductive element mounted on said weapon in position to close an electrical circuit between said first and second contact elements when said weapon is oriented at said pre-selected azimuth and to close an electrical circuit between said one of said first or second contact elements and said third contact element when said weapon is oriented at said pre-selected elevation; whereby said signal generators are energized when said weapon is in position for firing its projectile at said target.

6. Apparatus according to claim 5, further comprising positioning means mounted on said arm and spaced from said third contact element, for positioning said electrically conductive element at a fixed location relative to said third contact element.

7. Apparatus according to claim 1, wherein said weapon is an archery bow and arrow, wherein said first means comprises:

a bow engaging means fixedly positioned relative to said support element for locating the lower end of the bow relative to said support element;

an elongated arm pivotably connected to said support element for rotation through a plurality of elevational positions;

a first signal generator having actuator elements located on said arm in position to be actuated by said third means when said weapon is oriented at said pre-selected elevation.

8. Apparatus according to claim 7, further comprising a body engaging means fixedly positioned relative to said support element for positioning the user of said weapon.

9. Apparatus according to claim 1, wherein said weapon is an archery bow and arrow, wherein said second means comprises:

a bow engaging means fixedly positioned relative to said support element for locating the lower end of the bow relative to said support element;

an elongated arm pivotably connected to said support element for rotation through a plurality of azimuthal positions;

a signal generator having actuator elements located on said arm in position to be actuated by said third means when said weapon is oriented at said pre-selected azimuth.

10. Apparatus according to claim 9, further comprising a body engaging means fixedly positioned relative to said support element for enabling an archer to position himself relative to said support element.

* * * * *